US010823105B2

(12) United States Patent
Sanborn et al.

(10) Patent No.: US 10,823,105 B2
(45) **Date of Patent: *Nov. 3, 2020**

(54) METHODS AND SYSTEMS FOR HIGH PRESSURE FUEL PUMP COOLING

(71) Applicant: Ford Global Technologies, LLC, Dearborn, MI (US)

(72) Inventors: Ethan D. Sanborn, Saline, MI (US); Joseph Lyle Thomas, Holt, MI (US); Michael Anthony Pierce, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/189,103

(22) Filed: Nov. 13, 2018

(65) Prior Publication Data

US 2019/0078531 A1 Mar. 14, 2019

Related U.S. Application Data

(63) Continuation of application No. 15/676,440, filed on Aug. 14, 2017, now Pat. No. 10,125,715.

(60) Provisional application No. 62/400,484, filed on Sep. 27, 2016.

(51) Int. Cl.

| | |
|---|---|
| ***F02D 41/40*** | (2006.01) |
| ***F02D 41/08*** | (2006.01) |
| ***F02D 41/12*** | (2006.01) |
| ***F02D 41/38*** | (2006.01) |
| ***F02D 41/14*** | (2006.01) |
| ***F02D 41/30*** | (2006.01) |

(52) U.S. Cl.

CPC ..... *F02D 41/40* (2013.01); *F02D 41/08* (2013.01); *F02D 41/126* (2013.01); *F02D 41/1401* (2013.01); *F02D 41/3082* (2013.01); *F02D 41/3094* (2013.01); *F02D 41/38* (2013.01); *F02D 2041/1433* (2013.01); *F02D 2041/389* (2013.01); *F02D 2200/021* (2013.01); *F02D 2200/0602* (2013.01); *F02D 2200/0606* (2013.01); *F02D 2200/0608* (2013.01)

(58) Field of Classification Search

CPC ..... F02D 41/40; F02D 41/08; F02D 41/126; F02D 41/1401; F02D 41/3082; F02D 41/3094; F02D 41/38; F02D 2041/1433; F02D 2041/389; F02D 2200/021; F02D 2200/0602; F02D 2200/0606; F02D 2200/0608

See application file for complete search history.

(56) References Cited

U.S. PATENT DOCUMENTS 5,327,872 A 7/1994 Morikawa
7,281,517 B2 10/2007 Miyazaki et al.
(Continued)

*Primary Examiner* — Hieu T Vo
(74) *Attorney, Agent, or Firm* — Geoffrey Brumbaugh; McCoy Russell LLP

(57) ABSTRACT

Methods and systems are provided for temperature control of a high pressure pump (HPP) of a direct injection system. When direct injection is disabled, the HPP and the associated direct injectors are intermittently operated when the HPP temperature rises above a modeled threshold temperature. The HPP and injectors are operated until the HPP temperature falls below the modeled threshold temperature.

20 Claims, 5 Drawing Sheets

(56) References Cited

U.S. PATENT DOCUMENTS

| | | | | |
|---|---|---|---|---|
| 9,267,423 | B2 | 2/2016 | Russ et al. | |
| 10,125,715 | B2 * | 11/2018 | Sanborn | F02D 41/126 |

* cited by examiner

400

| | | | | | | |
|---|---|---|---|---|---|---|
| pfdim_te_dfi_fr_pc_dfi_min_a_n | -40 | 0 | 200 | 200 | 200 | 240 |
| pfdim_pc_dfi_min_a_1 | 0 | 0 | 0 | 20 | 20 | 50 |

600

| | 0 | 0.2 | 0.4 | 0.6 | 0.8 | 1.2 |
|---|---|---|---|---|---|---|
| 6000 | 0.8,0.2 | 0.8,0.2 | 0.8,0.2 | 0.8,0.2 | 0.8,0.2 | 0.8,0.2 |
| 5000 | 0.6,0.4 | 0.2,0.8 | 0.3,0.7 | 0.4,0.6 | 0.5,0.5 | 0.6,0.4 |
| 4000 | 0.3,0.7 | 0.1,0.9 | 1.0 | 0.2,0.8 | 0.2,0.8 | 0.3,0.7 |
| 3000 | 0.3,0.7 | 0.2,0.8 | 0,1 | 0,1 | .05,.95 | 1.0 |
| 2000 | 0.7,0.3 | 0.4,0.6 | 0,1 | 0,1 | 0,1 | 0.1,0.9 |
| 1000 | 0.9,0.1 | 0.7,0.3 | 0.5,0.5 | 0.3,0.7 | 0.2,0.8 | 0.1,0.9 |
| 0 | 1,0 | 0.8,0.2 | 0.8,0.2 | 0.5,0.5 | 0.2,0.8 | 0.2,0.8 |

ENGINE LOAD 602 606 604

FIG. 6

METHODS AND SYSTEMS FOR HIGH PRESSURE FUEL PUMP COOLING

CROSS REFERENCE TO RELATED APPLICATIONS

The present application is a continuation of U.S. patent application Ser. No. 15/676,440, entitled "Methods and Systems for High Pressure Fuel Pump Cooling," filed on Aug. 14, 2017, now U.S. Pat. No. 10,125,715. U.S. patent application Ser. No. 15/676,440 claims priority to U.S. Provisional Patent Application No. 62/400,484 entitled "Methods and Systems for High Pressure Fuel Pump Cooling," filed on Sep. 27, 2016. The entire contents of the above-referenced applications are hereby incorporated by reference in their entirety for all purposes.

FIELD

The present application relates generally to systems and methods for adjusting operation of fuel injectors of an internal combustion engine to maintain fuel pump temperature.

BACKGROUND/SUMMARY

Engines may be configured to deliver fuel to an engine cylinder using one or more of port and direct injection. Port fuel direct injection (PFDI) engines are capable of leveraging both fuel injection systems. For example, at high engine loads, fuel may be directly injected into an engine cylinder via a direct injector, thereby leveraging the charge cooling properties of the direct injection (DI). At lower engine loads and at engine starts, fuel may be injected into an intake port of the engine cylinder via a port fuel injector, reducing particulate matter emissions. In addition, the NVH impact on the customer is reduced since the direct injectors and a high pressure fuel pump (HPP) delivering fuel to the direct injectors can make a ticking noise when active. During still other conditions, a portion of fuel may be delivered to the cylinder via the port injector while a remainder of the fuel is delivered to the cylinder via the direct injector.

During periods of engine operation where direct injection of fuel is disabled and no fuel is being released by the direct injector (e.g., during conditions where only port injection of fuel is scheduled), fuel trapped inside the DI fuel rail may expand due to high temperatures. This can result in a pressure build-up in the DI fuel rail as well as elevated injector tip temperatures. In addition, the temperature of the HPP may rise. If the deactivation period of the DI is long, the pressure and temperature build-up may be significant. Prolonged exposure to such high temperature and pressure conditions may cause internal damage to the fuel system components. To address this, while direct injection is disabled, fuel flow through the HPP and the DI system may be continuously adjusted based on an expected (e.g., modeled) HPP temperature to provide sufficient flow to cool the HPP without increasing ticking noise. One example method includes: during an engine warm idling condition, maintaining each of engine direct injectors and a high pressure fuel pump delivering fuel to the direct injectors disabled until a modeled temperature of the pump is higher than a threshold; and then temporarily reactivating each of the engine direct injectors and the high pressure fuel pump until the modeled temperature is below the threshold.

As an example, during warm idling, an engine may be fueled via port injection only. A DI injection system and the HPP delivering fuel to the direct injectors may be disabled. Responsive to a rise in modeled HPP temperature above a threshold, the HPP and the DI injectors may be intermittently enabled and fuel may be injected via DI at a flow rate through the HPP that provides sufficient cooling. This may be continued until the HPP temperature is below the threshold. Thereafter, both the HPP and the direct injectors may be disabled and only port injection of fuel may be resumed.

In this way, temperature control may be achieved at a HPP delivering fuel to a DI fuel rail, particularly during conditions of extended operation with only port fuel injection. The technical effect of maintaining a minimum fuel flow through the DI fuel system components is that the HPP may be cooled. By modeling the HPP temperature based fuel system conditions, the DI fuel flow may be better adjusted to maintain the HPP temperature in a desired range. By operating the HPP and the direct injector intermittently to maintain the HPP temperature below a threshold temperature, internal damage to the high pressure fuel pump is reduced. In addition, the HPP and direct injectors may be maintained deactivated for a longer duration, reducing the occurrence of ticking, and related NVH issues. Even when the direct injectors and HPP are intermittently activated for temperature relief, the amount of objectionable noise generated may be substantially lower, or negligible.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 6 shows an example table of empirically determined port and direct fuel fractions (DI/PFI split ratio).

DETAILED DESCRIPTION

The following description relates to systems and methods for adjusting operation of fuel injectors of an internal combustion engine to enable cooling of a high pressure fuel pump. An example embodiment of a cylinder in an internal combustion engine with each of a direct injector and a port injector is given in FIG. 1. FIG. 2 depicts a fuel system that may be used with the engine system of FIG. 1. Pressurized fuel may be delivered to a direct injection fuel rail in the fuel system via a high pressure pump receiving fuel from a low pressure lift pump. A split ratio of fuel to be delivered via port injection relative to direct injection may be determined based an engine operating conditions, such as using the engine speed-load table of FIG. 6. During certain engine operating conditions, fuel may be delivered to the engine via port injection only and the direct injectors may be disabled. During prolonged period of deactivation of the direct injectors, temperature may build up at the high pressure fuel pump. An engine controller may perform a routine, such as the example routine of FIG. 3, to cool the high pressure fuel pump by maintaining a minimum flow through the direct injector. For example, a calibration of the direct injector may be adjusted, as shown with reference to the table of FIG. 4. An example fuel system operation for high pressure pump temperature control is shown with reference to FIG. 5. In this way, fuel system component damage may be averted.

Regarding terminology used throughout this detailed description, a high pressure pump, or direct injection pump, may be abbreviated as HPP. Similarly, a low pressure pump, or lift pump, may be abbreviated as a LPP. Port fuel injection may be abbreviated as PFI while direct injection may be abbreviated as DI. Also, fuel rail pressure, or the value of pressure of fuel within a fuel rail, may be abbreviated as FRP.

Figure 1:
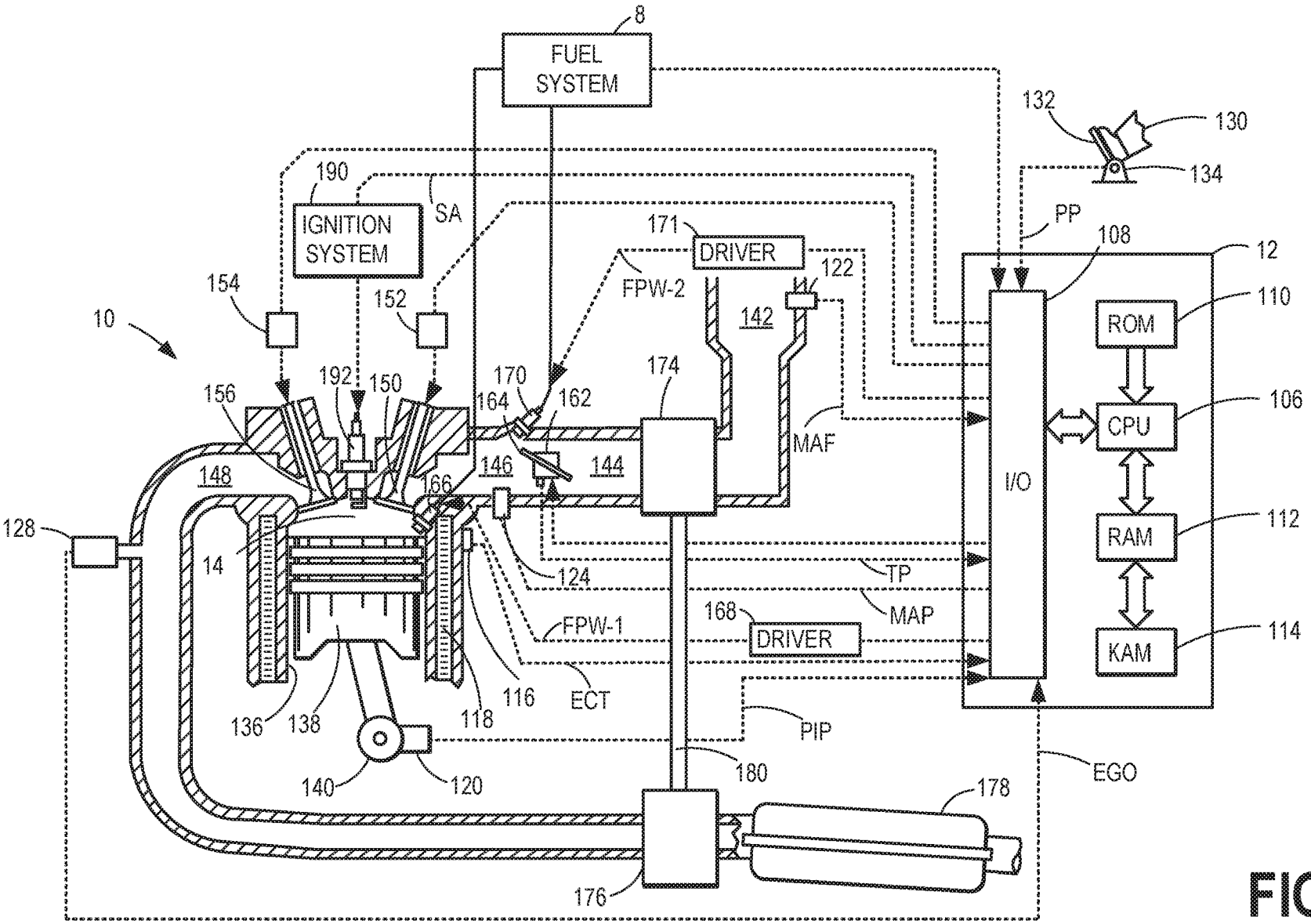
FIG. 1 schematically depicts an example embodiment of a cylinder of an internal combustion engine.
Figure 2:
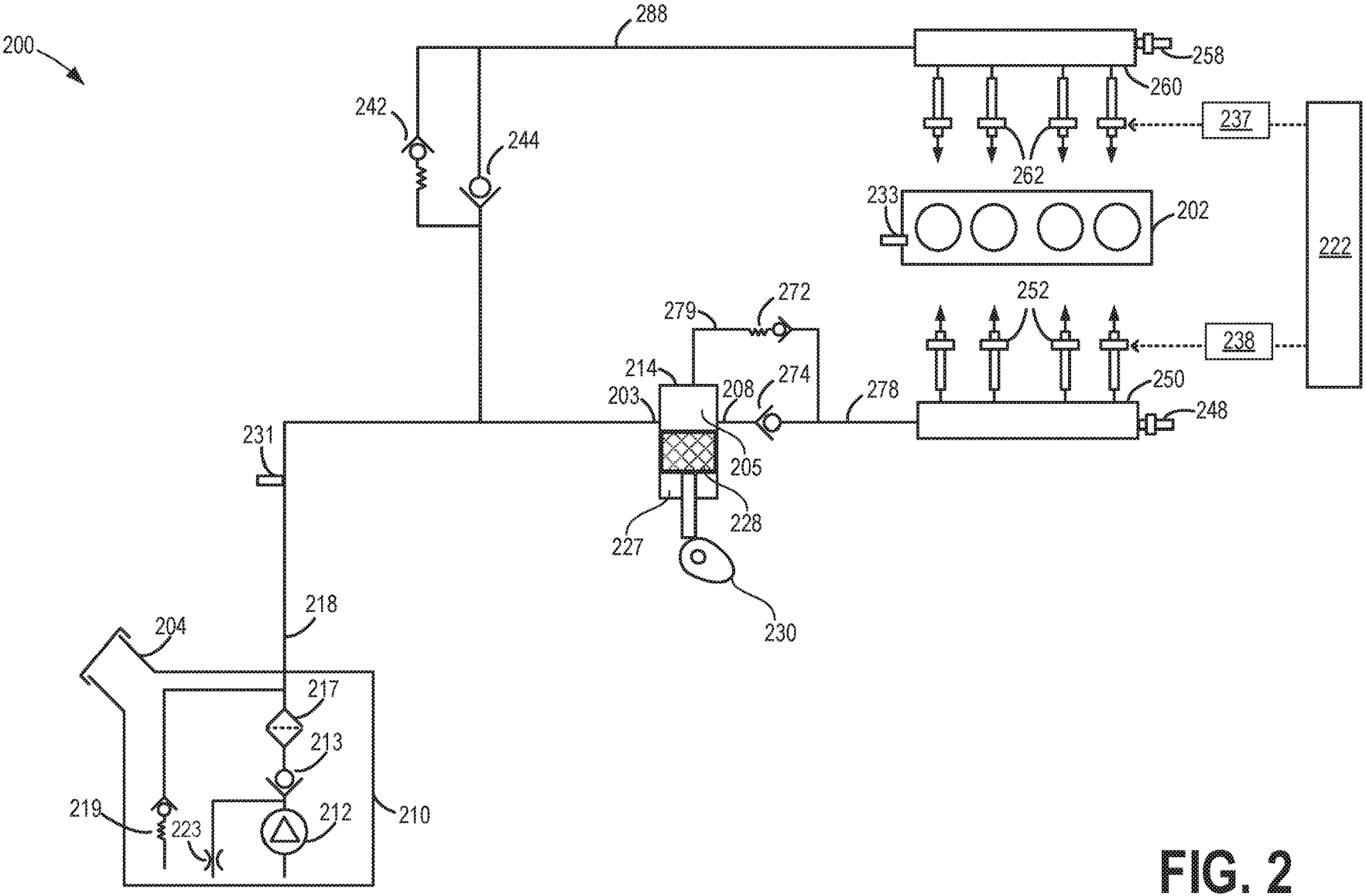
FIG. 2 schematically depicts an example embodiment of a fuel system, configured for port injection and direct injection that may be used with the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. The controller 12 receives signals from the various sensors of FIG. 1 and employs the various actuators of FIG. 1 to adjust engine operation based on the received signals and instructions stored on a memory of the controller. For example, based on a pulse-width signal commanded by the controller to a driver coupled to the direct injector, a fuel pulse may be delivered from the direct injector into a corresponding cylinder.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 schematically depicts an example embodiment 200 of a fuel system, such as fuel system 8 of FIG. 1. Fuel system 200 may be operated to deliver fuel to an engine, such as engine 10 of FIG. 1. Fuel system 200 may be operated by a controller to perform some or all of the operations described with reference to the method of FIG. 3.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at orifice 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Fuel lifted by the LPP 212 may also be supplied to a second fuel rail 260 coupled to one or more fuel injectors of a second group of port injectors 262 (herein also referred to as a second injector group). HPP 214 may be operated to raise the pressure of fuel delivered to the first fuel rail above the lift pump pressure, with the first fuel rail coupled to the direct injector group operating with a high pressure. As a result, high pressure DI may be enabled while PFI may be operated at a lower pressure.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a BOSCH HDP5 HIGH PRESSURE PUMP, which utilizes a solenoid activated control valve (e.g., fuel volume regulator, magnetic solenoid valve, etc.) to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. A check valve 274 and a pressure relief valve (also known as pump relief valve) 272 may be positioned between the outlet 208 of the HPP 214 and the first (DI) fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of HPP 214 and upstream of first fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure. Valves 244 and 242 work in conjunction to keep the low pressure fuel rail 260 pressurized to a pre-determined low pressure. Pressure relief valve 242 helps limit the pressure that can build in fuel rail 260 due to thermal expansion of fuel.

Based on engine operating conditions, fuel may be delivered by one or more port injectors 262 and direct injectors 252. For example, during high load conditions, fuel may be delivered to a cylinder on a given engine cycle via only direct injection, wherein port injectors 262 are disabled. In another example, during mid-load conditions, fuel may be delivered to a cylinder on a given engine cycle via each of direct and port injection. As still another example, during low load conditions, engine starts, as well as warm idling conditions, fuel may be delivered to a cylinder on a given engine cycle via only port injection, wherein direct injectors 252 are disabled.

Since fuel injection from the direct injectors results in injector cooling, and fuel flow through the HPP results in pump cooling, after a period of inactivity, pressure may build up from fuel trapped at the DI fuel rail 250, resulting in an elevated temperature and pressure being experienced at the DI fuel rail 250 as well as HPP 214. In addition, direct injector tip temperatures may rise. Under such circumstances, the HPP temperature needs to be cooled to prevent damage to fuel system components. As elaborated herein with reference to FIG. 3, to cool the HPP, fuel flow through the HPP and DI fuel injector may be temporarily enabled. In addition, a port injection fuel fraction may be adjusted based on the DI fuel flow to maintain a combustion air-fuel ratio. By maintaining a minimum flow through the HPP and activating the direct injectors to deliver a small pulse of fuel, the required degree of cooling may be provided. Once the HPP temperature is within a desired range, the direct injectors may be disabled and fuel injection via only port injection may be resumed.

In this way, by providing temperature relief at the high pressure fuel pump, damage to fuel system components may be reduced. By temporarily enabling the direct injectors for a short duration to provide fuel pulses of small pulse-width, NVH issues, such as ticking noises associated with the use of DI fuel system components, can be reduced. For example, a lower volume ticking noise may be generated that is low enough to be masked by engine noise such that it is not audible (or objectionable) to the operator.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Controller 12 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed, flow output, and/or pressure) of the low pressure pump.

In this way, the components of FIGS. 1-2 enable a system comprising: an engine, a fuel tank; a port injector receiving fuel from the fuel tank via a lift pump; a direct injector receiving fuel from the fuel tank via a high pressure fuel pump coupled downstream of the lift pump; an engine coolant temperature sensor; and a controller with computer readable instructions stored on non-transitory memory for: during warm engine idling conditions, fueling an engine cylinder via only the port injector while the direct injector and the high pressure pump are maintained disabled; modeling a temperature of the high pressure fuel pump based at least on an output of the temperature sensor while the direct injector and the high pressure pump are held disabled; and responsive to the modeled temperature exceeding a threshold, intermittently reactivating the direct injector and the high pressure pump. For example, the intermittently reactivating may include, while maintaining fueling via the port injector, fueling the engine cylinder via the direct injector with the high pressure pump enabled until the modeled temperature is lower than the threshold, an output of the high pressure pump adjusted based on a difference between the modeled temperature and the threshold. The controller may include further instructions for estimating a drop in the modeled temperature during the selectively reactivating based on each of the output of the high pressure pump, a cooling effect of fuel flow through the direct injector, and a heat transfer function of the high pressure pump. Further, the controller may include instructions for reducing fueling via the port injector while fueling the engine cylinder via the direct injector.

Figure 3:
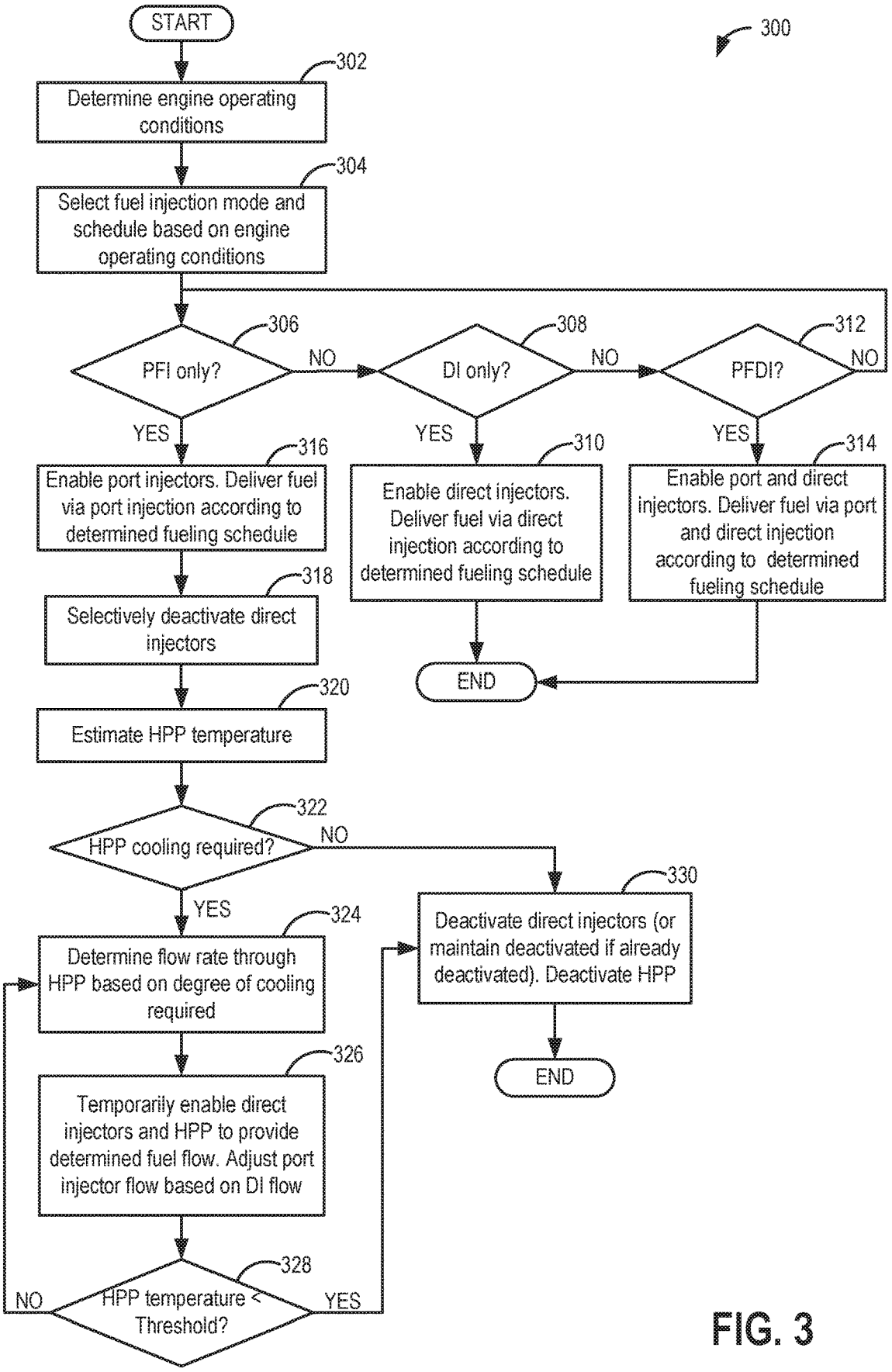
FIG. 3 shows a flow chart illustrating a method that may be implemented for cooling a high pressure fuel pump of the fuel system of FIG. 2.

FIG. 3 illustrates an example method 300 for reducing HPP over-temperature conditions. Instructions for carrying out method 300 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At 302, engine operating conditions may be determined by the controller. The engine operating conditions may include engine load, engine temperature, engine speed, operator torque demand, etc. Depending on the estimated operating conditions, a plurality of engine parameters may be determined. For example, at 304, a fuel injection schedule may be determined. This includes determining an amount of fuel to be delivered to a cylinder (e.g., based on the torque demand), as well as a fuel injection timing. Further, a fuel injection mode and a split ratio of fuel to be delivered via port injection relative to direct injection may be determined for the current engine operating conditions. In one example, at high engine loads, direct injection (DI) of fuel into an engine cylinder via a direct injector may be selected in order to leverage the charge cooling properties of the DI so that engine cylinders may operate at higher compression ratios without incurring undesirable engine knock. If direct injection is selected, the controller may determine whether the fuel is to be delivered as a single injection or split into multiple injections, and further whether to deliver the injection(s) in an intake stroke and/or a compression stroke. In another example, at lower engine loads (low engine speed) and at engine starts (especially during cold-starts), port injection (PFI) of fuel into an intake port of the engine cylinder via a port fuel injector may be selected in order to reduce particulate matter emissions. If port injection is selected, the controller may determine whether the fuel is to be delivered during a closed intake valve event or an open intake valve event. There may be still other conditions where a portion of the fuel may be delivered to the cylinder via the port injector while a remainder of the fuel is delivered to the cylinder via the direct injector. Determining the fuel injection schedule may also include, for each injector, determining a fuel injector pulse-width as well as a duration between injection pulses based on the estimated engine operating conditions.

In one example, the determined fuel schedule may include a split ratio of fuel delivered via port injection relative to direct injection, the split ratio determined from a controller look-up table, such as the example table of FIG. 6. With reference to FIG. 6, a table 600 for determining port and direct fuel injector fuel fractions for a total amount of fuel supplied to an engine during an engine cycle is shown. The table of FIG. 6 may be a basis for determining a mode of fuel system operation (DI only, PFI only, or PFI and DI combined (PFDI)), as elaborated in the method of FIG. 3. The vertical axis represents engine speed and engine speeds are identified along the vertical axis. The horizontal axis represents engine load and engine load values are identified along the horizontal axis. In this example, table cells 602 include two values separated by a comma. Values to the left sides of the commas represent port fuel injector fuel fractions and values to the right sides of commas represent direct fuel injector fuel fractions. For example, for the table value corresponding to 2000 RPM and 0.2 load holds empirically determined values 0.4 and 0.6. The value of 0.4 or 40% is the port fuel injector fuel fraction, and the value 0.6 or 60% is the direct fuel injector fuel fraction. Consequently, if the desired fuel injection mass is 1 gram of fuel during an engine cycle, 0.4 grams of fuel is port injected fuel and 0.6 grams of fuel is direct injected fuel. In other examples, the table may only contain a single value at each table cell and the corresponding value may be determined by subtracting the value in the table from a value of one. For example, if the 2000 RPM and 0.2 load table cell contains a single value of 0.6 for a direct injector fuel fraction, then the port injector fuel fraction is 1−0.6=0.4.

It may be observed in this example that the port fuel injection fraction is greatest at lower engine speeds and loads. In the depicted example, table cell 604 represents an engine speed-load condition where all the fuel is delivered via port injection only. At this speed-load condition, direct injection is disabled. The direct fuel injection fraction is greatest at middle level engine speeds and loads. In the depicted example, table cell 606 represents an engine speed-load condition where all the fuel is delivered via direct injection only. At this speed-load condition, port injection is disabled. The port fuel injection fraction increases at higher engine speeds where the time to inject fuel directly to a cylinder may be reduced because of a shortening of time between cylinder combustion events. It may be observed that if engine speed changes without a change in engine load, the port and direct fuel injection fractions may change.

Returning to FIG. 3, at 306, the routine includes determining if a port fuel injection-only (PFI-only) mode has been selected based on the current engine operating conditions. Fuel delivery via only PFI may be requested, for example, during conditions of low engine load and low engine temperature, as well as during engine starts. If a PFI-only mode is not selected, at 308, the routine includes determining if a direct fuel injection only (DI-only) mode has been requested. Fuel delivery via only DI may be desirable, for example, during high engine load and/or during conditions of high engine temperature. If a DI-only mode is confirmed, at 310, direct injectors may be enabled and fuel may be injected into the engine via the direct injectors (such as direct injectors 252 of FIG. 1). The controller may adjust an injection pulse-width of the direct injectors in order to provide fuel via the direct injectors according to the determined fueling schedule.

If neither the PFI-only nor the DI-only mode is selected, at 312, the routine includes confirming that fuel delivery via both DI and PFI has been requested (herein also referred to as the PFDI mode). If it is determined that fuel delivery via both direction injection and port injection has been selected, at 314, the controller may activate both the port and direct injectors. Further, the controller may send a signal to actuators coupled to each of the direct injector and the port injector of each cylinder to deliver fuel based on the determined fueling schedule. Each injector may deliver a portion of a total fuel injection that is combusted in the cylinder. As described with reference to FIG. 6, a split ratio of fuel delivered via PFI relative to DI may be retrieved from a look-up table and control signals may be sent to the injectors to provide fuel according to the determined split ratio. As such, the distribution and/or relative amount of fuel delivered from each injector may vary based on operating conditions such as engine load, knock propensity, engine speed, exhaust temperature, etc.

Returning to 306, if the PFI-only mode is confirmed, at 316, the method includes enabling the port injectors and delivering fuel via the port injectors in accordance with the determined fueling schedule. For example, the controller may command a pulse width corresponding to the determined fuel amount to the port injector (such as port injectors 262 of FIG. 1). A timing of the port injection may be adjusted with reference to an intake valve timing of the cylinder based on whether open valve or closed valve port injection was selected in the determined fueling schedule. In addition to enabling the port injectors, at 318, the method includes temporarily deactivating the direct injectors.

As such, when direct injection is deactivated, there may be no fuel flow fuel via the high pressure fuel pump (such as HPP 214 of FIG. 2). In addition, fuel may not be delivered to the cylinder via the direct injection fuel rail (such as the DI fuel rail 250 in FIG. 2) or the direct injectors. Since fuel flow through the HPP cools and lubricates the pump, the lack of fuel flow through the pump during the PFI-only mode can result in a temperature of the HPP starting to rise. In addition, any fuel trapped inside the DI fuel rail may expand due to high temperatures. Since fuel injection results in injector cooling, the lack of direct injection also results in elevated injector tip temperatures. As such, if the direct injectors are held disabled for an extended period of time, the temperature built up at the HPP and the injector tips may be significant, and may cause internal damage to various fuel system components.

To address this issue, at 320, while the direct injectors are disabled, a temperature of the HPP may be estimated (e.g., predicted or modeled) by the controller. In one example, the HPP temperature may be predicted or modeled based on engine coolant temperature (ECT) estimated by an ECT sensor. In another example, the HPP temperature may be modeled using a physics-based model that takes into account cooling effects of fuel flow, and heat transfer functions at the pump. As an example, the expected HPP temperature may be modeled based on a duration of DI deactivation (or duration of operation in the PFI-only mode) and further based on one or more of DI fuel rail temperature and DI injector tip temperature. The modeled HPP temperature may increase as the duration of DI deactivation increases, as the fuel rail temperature increases, and/or as the DI injector tip temperature increases. The DI fuel rail pressure may be determined based on input from a fuel rail pressure sensor (such as the DI fuel rail pressure sensor 248 in FIG. 2).

At 322, it may be determined if HPP cooling is required. It will be appreciated that HPP cooling may be assessed only when the engine is in a warm mode, after a catalyst light-off temperature has been exceeded and an engine cold-start has been completed. For example, HPP cooling may be assessed only during warm idling conditions.

In one example, the modeled HPP temperature may be compared to a threshold temperature (e.g., an upper threshold temperature) and it may be determined if the modeled temperature exceeds the threshold temperature. Alternatively, it may be determined if the modeled temperature exceeds the threshold temperature by more than a threshold difference. In one example, HPP cooling may be required if the modeled HPP temperature exceeds 200° F. If HPP cooling is not required, at 330, the direct injectors are maintained disabled and fuel injection in the PFI-only mode is continued. In addition the HPP is deactivated.

If HPP cooling required, such as when the modeled HPP temperature exceeds the HPP temperature threshold, at 324, the method includes determining a fuel flow (amount, rate, etc.) through an activated HPP that provides the required degree of cooling. As such, the determined fuel flow may correspond to a minimum fuel flow through the HPP required to cool the HPP.

For example, a minimum fuel flow rate through the reactivated HPP that enables the HPP temperature to be lowered below the threshold temperature (e.g., to at least a lower threshold temperature, lower than the upper threshold temperature) is determined. In one example, a flow rate may be determined that enables the modeled HPP temperature to be lowered to at least 195° F. Based on the fuel flow required, a DI injection pulse-width and an updated PFI:DI split ratio may be determined to provide the requisite cooling. In addition, a number of direct injection pulses to be delivered may be determined. Further, an HPP output may be determined that provides the required fuel flow.

At 326, the direct injectors may be temporarily enabled and a pulse-width may be commanded to the direct injectors to provide the determined fuel flow through the HPP. In addition, the HPP is activated to pump fuel into the direct injection fuel rail with a consequent rise in fuel rail temperature. Further, for the cylinder fueling events where at least a portion of fuel is delivered via direct injection, a port injection pulse-width commanded may be adjusted so as to maintain a combustion air-fuel ratio and also to maintain a total net amount of fuel delivered. For example, as the direct injection pulse-width is increased, and for the number of combustion events where direct injection is enabled, a commanded pulse-width of port injection may be decreased to provide a given total amount of fuel.

At 328, it may be determined if the modeled HPP temperature following the cooling fuel flow is below a threshold temperature (such as below the lower threshold temperature). If not, then the routine returns to 324 to resume determining a fuel flow required through the HPP to provide a desired degree of (further) pump cooling. Else, if the required degree of cooling has been provided and the modeled HPP temperature is below the threshold temperature, the routine moves to 330 where the direct injectors are disabled and fuel injection in the PFI-only mode is resumed. Also, the HPP is deactivated with a consequent drop in direct injection fuel rail temperature. In addition, the port injection fuel pulse-width is readjusted to account for no fuel being delivered via the direct injectors anymore. In this way, a minimum flow of fuel through an HPP and direct injectors may be intermittently provided during port injection only conditions to cool the HPP.

Figures 4, 5:
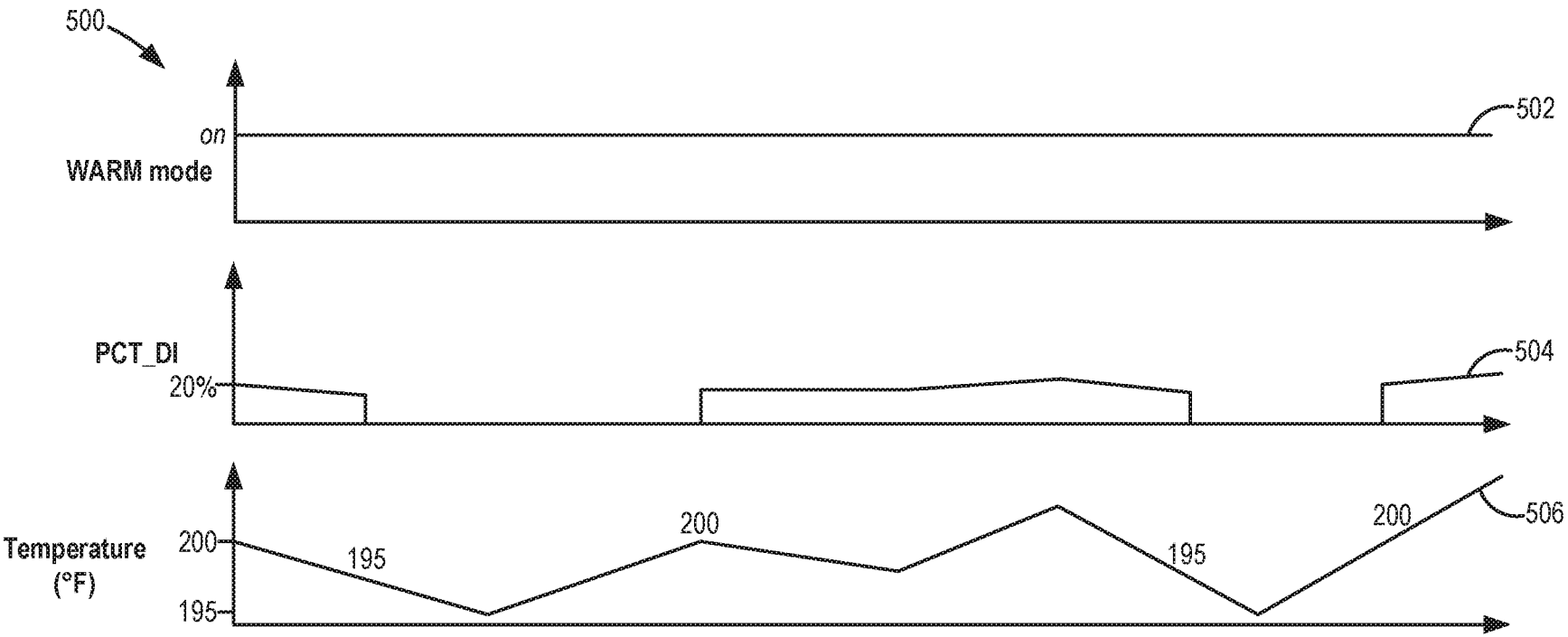
FIG. 4 shows an example table of fuel calibration for direct injected fuel that enables cooling of a high pressure fuel pump.
FIG. 5 shows example plots of HPP temperature relief using direct injection flow control.

In one example, the controller may refer to a calibration table, such as the example calibration table 400 of FIG. 4 to determine a DI fuel fraction that enables HPP cooling. As depicted in FIG. 4, during port injection only conditions when the HPP is at lower HPP temperatures, NVH from DI system components (such as ticking noise from DI injectors and the HPP) may be reduced by maintaining the DI and HPP disabled and providing all fuel via port injection only (and the lift pump). Responsive to an increase in modeled HPP temperature (due to the DI system being deactivated), the HPP may be activated and the DI fuel fraction (percent DI relative to percent PFI) may be raised, for example from 0 to 20% responsive to the temperature reaching 200° F. As the temperature increases further, such as to 240° F., the DI fuel fraction (percent DI relative to percent PFI) may be raised further, for example from 20% to 50%.

In this way, during warm engine idling where the engine is fueled via port injectors only, an engine controller may selectively reactivate each of engine direct injectors and a high pressure fuel pump delivering fuel to the direct injectors for a duration responsive to a modeled temperature of the pump being higher than an upper threshold, the duration adjusted to reduce the modeled temperature below a lower threshold. In one example, the lower threshold is a function of the upper threshold, and wherein the engine warm idling includes engine operation at lower than a threshold speed. Further, while the engine is fueled via port injectors only, the controller may model the temperature of the deactivated high pressure pump as a function of each of measured engine coolant temperature and an amount of time elapsed since a last deactivation of the engine direct injectors. In one example, the selectively reactivating for a duration includes temporarily reactivating each of the engine direct injectors and the high pressure fuel pump until the modeled temperature is below the lower threshold, and then deactivating each of the engine direct injectors and the high pressure fuel pump. The selectively reactivating for the duration may further include estimating a target fuel flow through the pump based on a difference between the modeled temperature and the lower threshold, and adjusting each of a duty cycle commanded to the pump and the duration of selective reactivation based on the target fuel flow. In addition, for the duration when each of the engine direct injectors and the high pressure fuel pump are selectively reactivated, the controller may adjust a duty cycle commanded to the port injectors, the duty cycle commanded to the port injectors reduced as the duration of selective reactivation of the direct injectors increases.

Turning now to FIG. 5, an example map 500 is shown for adjusting cylinder fueling to control HPP temperature. Map 500 depicts a warm mode of engine operation (on or off) at plot 502, a DI fuel fraction (percent DI or PCT DI) at plot 504, and a modeled HPP temperature (for example, modeled based on an estimated fuel rail temperature) at plot 506. All plots are depicted over time. The warm mode of engine operation includes engine operation during warm idling conditions, such as after a catalyst light-off.

As shown at FIG. 5, the HPP is intermittently activated when the modeled HPP temperature rises above an upper threshold temperature (e.g., at or above 200° F.) and maintained enabled until the modeled HPP temperature falls below a lower threshold temperature (e.g., at or below 195° F.), providing a hysteresis. The DI fuel fraction consequently changes from 0 to 20% and then back to 20%. It will be appreciated that the DI fuel fraction adjustments for HPP cooling are performed only after the engine has entered a warm mode, such as after a catalyst light-off temperature has been reached.

In this way, the temperature of an HPP delivering fuel to a DI fuel rail may be maintained. By enabling fuel flow through the HPP during conditions when the engine is warm and being fueled by port injection only, HPP cooling may be provided, reducing component damage.

An example method includes: during an engine warm idling condition, maintaining each of engine direct injectors and a high pressure fuel pump delivering fuel to the direct injectors disabled until a modeled temperature of the pump is higher than a threshold; and then temporarily reactivating each of the engine direct injectors and the high pressure fuel pump until the modeled temperature is below the threshold. In the preceding example, additionally or optionally, the warm idling condition includes operating the engine below a threshold engine speed and supplying fuel to the engine via port injectors only. In any or all of the preceding examples, additionally or optionally, each of the engine direct injectors and the high pressure fuel pump is maintained disabled until the modeled temperature is higher than an upper threshold, and wherein the temporarily reactivating is performed until the modeled temperature is below a lower threshold. In any or all of the preceding examples, additionally or optionally, the modeled temperature of the pump is based on each of an engine coolant temperature and a duration of deactivation of the engine direct injectors. In any or all of the preceding examples, additionally or optionally, the reactivating includes intermittently injecting fuel via the direct injectors and the high pressure fuel pump until the modeled temperature is below the threshold. In any or all of the preceding examples, additionally or optionally, the reactivating includes adjusting a fuel pulse-width and interval of the intermittently injecting based on a difference between the modeled temperature and the threshold. In any or all of the preceding examples, additionally or optionally, the method further comprises, adjusting fueling via the port injectors based on the intermittent injection via the direct injectors. In any or all of the preceding examples, additionally or optionally, the reactivating includes adjusting an output of the pump to provide a target fuel flow through the pump, the target fuel flow based on a difference between the modeled temperature and the threshold. In any or all of the preceding examples, additionally or optionally, the target fuel flow includes one or more of a target fuel flow amount and a target fuel flow rate.

Another example method comprises: during warm engine idling where the engine is fueled via port injectors only, selectively reactivating each of engine direct injectors and a high pressure fuel pump delivering fuel to the direct injectors for a duration responsive to a modeled temperature of the pump being higher than an upper threshold, the duration adjusted to reduce the modeled temperature below a lower threshold. In the preceding example, additionally or optionally, the lower threshold is a function of the upper threshold, and wherein the engine warm idling includes engine operation at lower than a threshold speed. In any or all of the preceding examples, additionally or optionally, the method further comprises, while the engine is fueled via port injectors only, modeling the temperature of the pump as a function of each of measured engine coolant temperature and an amount of time elapsed since a last deactivation of the engine direct injectors. In any or all of the preceding examples, additionally or optionally, selectively reactivating for a duration includes temporarily reactivating each of the engine direct injectors and the high pressure fuel pump until the modeled temperature is below the lower threshold, and then deactivating each of the engine direct injectors and the high pressure fuel pump. In any or all of the preceding examples, additionally or optionally, the selectively reactivating for the duration includes estimating a target fuel flow through the pump based on a difference between the modeled temperature and the lower threshold; and adjusting each of a duty cycle commanded to the pump and the duration of selective reactivation based on the target fuel flow. In any or all of the preceding examples, additionally or optionally, the method further comprises, for the duration when each of the engine direct injectors and the high pressure fuel pump are selectively reactivated, adjusting a duty cycle commanded to the port injectors, the duty cycle commanded to the port injectors reduced as the duration of selective reactivation of the direct injectors increases.

Another example engine system comprises: an engine including a cylinder, a fuel tank; a port injector coupled to the cylinder, the port injector receiving fuel from the fuel tank via a lift pump; a direct injector coupled to the cylinder, the direct injector receiving fuel from the fuel tank via a high pressure fuel pump coupled downstream of the lift pump; an engine coolant temperature sensor; and a controller with computer readable instructions stored on non-transitory memory for: during warm engine idling conditions, fueling an engine cylinder via only the port injector while the direct injector and the high pressure pump are maintained disabled; modeling a temperature of the high pressure fuel pump based at least on an output of the temperature sensor while the direct injector and the high pressure pump are held disabled; and responsive to the modeled temperature exceeding a threshold, intermittently reactivating the direct injector and the high pressure pump. In the preceding example, additionally or optionally, the intermittently reactivating includes, while maintaining fueling via the port injector, fueling the engine cylinder via the direct injector with the high pressure pump enabled until the modeled temperature is lower than the threshold, an output of the high pressure pump adjusted based on a difference between the modeled temperature and the threshold. In any or all of the preceding examples, additionally or optionally, the controller includes further instructions for estimating a drop in the modeled temperature during the selectively reactivating based on each of the output of the high pressure pump, a cooling effect of fuel flow through the direct injector, and a heat transfer function of the high pressure pump. In any or all of the preceding examples, additionally or optionally, the controller includes further instructions for reducing fueling via the port injector while fueling the engine cylinder via the direct injector.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system, comprising:

an engine including a cylinder;

a fuel tank;

a port fuel injector (PFI), coupled to the cylinder, the port fuel injector receiving fuel from the fuel tank via a lift pump;

a direct injector (DI) coupled to the cylinder, the DI receiving fuel from the fuel tank via a high pressure fuel pump coupled downstream of the lift pump;

a turbocharger for providing a boosted aircharge to the engine cylinder;

an engine coolant temperature sensor; and a controller with computer readable instructions stored on non-transitory memory for:

while operating the engine at an air-fuel ratio with fuel injection in a PFI-only mode, modeling a rise in temperature of the high pressure fuel pump based at least on an output of the temperature sensor while the DI and the high pressure fuel pump are held disabled; and responsive to the modeled rise in temperature exceeding a threshold, intermittently reactivating the DI and the high pressure fuel pump, an output of the high pressure fuel pump adjusted to reduce the modeled rise in temperature below the threshold; and adjusting fueling via the PFI based on fueling via the DI during the intermittently reactivating to maintain the air-fuel ratio.

2. A method, comprising:

during an engine warm idling condition, modeling a temperature of a high pressure fuel pump configured to deliver fuel to direct injectors as a function of each of measured engine coolant temperature and an amount of time elapsed since a last deactivation of each of the direct injectors; and temporarily reactivating each of the direct injectors and the high pressure fuel pump responsive to the modeled temperature exceeding a threshold.

3. The method of claim 2, further comprising, maintaining each of the direct injectors and the high pressure fuel pump reactivated until the modeled temperature of the high pressure fuel pump is lower than the threshold.

4. The method of claim 2, wherein the engine is a boosted engine, and wherein the warm idling condition includes operating the engine below a threshold engine speed and supplying fuel to the engine via port injectors only.

5. The method of claim 4, wherein the warm idling condition further includes after a catalyst light-off temperature has been exceeded and an engine cold-start has been completed.

6. The method of claim 2, wherein the modeled temperature is further based on one or more of direct injection fuel rail temperature and direct injector tip temperature.

7. The method of claim 2, wherein the temporarily reactivating includes intermittently injecting fuel via the direct injectors and the high pressure fuel pump until the modeled temperature is below the threshold.

8. The method of claim 7, wherein the temporarily reactivating includes adjusting a fuel pulse-width and interval of the reactivated direct injectors based on a difference between the modeled temperature and the threshold.

9. The method of claim 8, further comprising, adjusting fueling via the port injectors based on the intermittent injection via the direct injectors to maintain a combustion air-fuel ratio at a target air-fuel ratio.

10. The method of claim 9, wherein adjusting fueling via the port injectors includes adjusting a split ratio of fuel delivered to each engine cylinder via the port injectors relative to the direct injectors.

11. The method of claim 2, wherein the temporarily reactivating includes determining a fuel flow through an activated high pressure fuel pump that provides a degree of cooling to reduce the modeled temperature below the threshold, the determined fuel flow including a fuel amount and a fuel flow rate.

12. The method of claim 2, wherein the threshold is an upper threshold, and wherein the temporarily reactivating is responsive to the modeled temperature exceeding the upper threshold.

13. The method of claim 12, further comprising, maintaining each of the direct injectors and the high pressure fuel pump reactivated until the modeled temperature of the high pressure fuel pump is lower than a lower threshold, the lower threshold lower than the upper threshold, and the lower threshold determined as a function of the upper threshold.

14. The method of claim 2, wherein temporarily reactivating each of the direct injectors and the high pressure fuel pump responsive to the modeled temperature exceeding the threshold includes temporarily reactivating responsive to the modeled temperature exceeding the threshold by more than a threshold amount.

15. A method, comprising:

while an engine is fueled via port injectors only, modeling a temperature of a deactivated high pressure fuel pump;

selectively reactivating each of engine direct injectors and the high pressure fuel pump delivering fuel to the direct injectors for a duration responsive to the modeled temperature of the high pressure fuel pump exceeding an upper threshold, the high pressure fuel pump and direct injectors maintained reactivated until the modeled temperature drops below a lower threshold.

16. The method of claim 15, wherein the lower threshold is a function of the upper threshold, and wherein the engine warm idling includes engine operation at lower than a threshold speed after a catalyst light-off temperature has been exceeded and an engine cold-start has been completed.

17. The method of claim 15, wherein the modeling of the temperature is as a function of each of measured engine coolant temperature and an amount of time elapsed since a last deactivation of the direct injectors.

18. The method of claim 15, further comprising, responsive to the modeled temperature falling below the lower threshold, deactivating each of the direct injectors and the high pressure fuel pump.

19. The method of claim 15, wherein the selectively reactivating for the duration includes:

estimating a target fuel flow through the high pressure fuel pump based on a difference between the modeled temperature and the lower threshold; and adjusting each of a duty cycle commanded to the high pressure fuel pump and the duration of selective reactivation based on the target fuel flow.

20. The method of claim 19, further comprising, for the duration when each of the engine direct injectors and the high pressure fuel pump are selectively reactivated, adjusting a duty cycle commanded to the port injectors, the duty cycle commanded to the port injectors reduced as the duration of selective reactivation of the direct injectors increases.

* * * * *